United States Patent [19]

Candland

[11] Patent Number: 4,870,886

[45] Date of Patent: Oct. 3, 1989

[54] TEMPERATURE COMPENSATING VARIABLE STROKE PROJECTILE POSITIONING SYSTEM

[75] Inventor: Calvin T. Candland, Eden Prairie, Minn.

[73] Assignee: Honeywell Inc., Minneapolis, Minn.

[21] Appl. No.: 264,921

[22] Filed: Oct. 31, 1988

[51] Int. Cl.[4] ..... F41F 9/06

[52] U.S. Cl. ..... 89/7; 89/47; 89/41.03

[58] Field of Search ..... 89/7, 41.03, 1.814, 89/1.81, 1.813, 1.818, 47, 33.05; 102/381, 289

[56] References Cited

U.S. PATENT DOCUMENTS

| | | | |
|---|---|---|---|
| 1,310,890 | 7/1919 | Schneider | 89/47 |
| 2,346,877 | 4/1944 | Trofimov | 89/47 |
| 3,004,475 | 10/1961 | Barr et al. | 89/1.814 |
| 3,888,159 | 6/1975 | Elmore et al. | 89/7 |
| 4,161,133 | 7/1979 | Black et al. | 89/7 |
| 4,172,408 | 10/1979 | Ayler et al. | 89/7 |
| 4,335,657 | 6/1982 | Bains | 102/433 |
| 4,406,229 | 9/1983 | Greene et al. | 102/530 |
| 4,722,261 | 2/1988 | Titus | 89/7 |

FOREIGN PATENT DOCUMENTS

| | | | |
|---|---|---|---|
| 79077 | 5/1919 | Fed. Rep. of Germany | 89/7 |
| 100540 | 5/1916 | United Kingdom | 89/7 |
| 260093 | 10/1926 | United Kingdom | 89/47 |

*Primary Examiner*—Deborah L. Kyle
*Assistant Examiner*—Stephen Johnson
*Attorney, Agent, or Firm*—Roger W. Jensen

[57] ABSTRACT

A variable stroke projectile postioning system compensates for temperature by adjusting the volume of a munition chamber which communicates with a projectile and contains a propellant having temperature dependent performance characteristics. The projectile positioning system includes method and apparatus which perform the operative steps of moving the projectile at a forward end of the chamber where its position defines the volume of the chamber, measuring the temperature of the propellant charge to be placed in the chamber for firing the projectile and having temperature dependent performance characteristics, and controlling the moving the projectile in response to the measured temperature of the propellant charge to cause the projectile to be placed at the exact position where it adjusts the amount of chamber volume to provide the correct degree of compensation for the measured temperature.

10 Claims, 2 Drawing Sheets

TEMPERATURE COMPENSATING VARIABLE STROKE PROJECTILE POSITIONING SYSTEM

CROSS REFERENCE TO RELATED APPLICATIONS

Reference is hereby made to the following co-pending U.S. patent applications dealing with related subject matter and assigned to the same assignee of the present invention:

1. "Temperature Compensating Ballistic Control Tube" by Steven P. Neubauer, assigned U.S. Ser. No. 041,499 and filed Apr. 23, 1987.

BACKGROUND OF THE INVENTION

1. Field of the Invention

The present invention generally relates to munitions and, more particularly, is concerned with a temperature compensating variable stroke projectile positioning system for adjusting primary propellant chamber volume for separate loaded ammunition.

2. Description of the Prior Art

Projectile munitions have varied performance dependent on environmental temperatures. Propellants of the munitions typically provide high performance under high ambient temperatures. However, under cold conditions such munitions exhibit low performance due to the slower burn rate or degradation of propellants.

To increase performance of cold munitions, the temperature of propellants may be increased. However, such heated munitions may be dangerous if designed for maximum performance under colder environmental conditions. So for reasons of safety of firing crews and of avoiding excessive stress on firing mechanisms, most munitions are designed to reach maximum allowable pressure only at high ambient temperatures. Such a design results in low performance munitions at medium or low temperature climatic conditions.

Two approaches to temperature compensating control of projectile munitions propellants for improving munitions performance at all environmental temperatures, i.e., temperature independent performance, are disclosed in the patent applications cross-referenced above (but are not considered to be prior art to the present invention). In the first cross-referenced application, temperature compensation is achieved by changing the volume of the container holding the primary propellant by moving the projectile using a temperature-sensitive secondary charge-driven piston.

Although both of these approaches constitute steps in right direction, other approaches still need to be explored in searching for ways to ensure optimal performance of projectile munitions at all environmental temperatures.

SUMMARY OF THE INVENTION

The present invention provides a temperature compensating variable stroke projectile positioning system designed to satisfy the aforementioned needs. In particular, the present invention relates to a projectile positioning system employing a propellant temperature sensing device and a variable stroke drive ram for adjusting the position of the projectile and thereby the volume of a chamber which receives a propellant having temperature dependent performance characteristics.

Accordingly, the present invention is directed to a temperature compensating variable stroke projectile positioning method and apparatus for adjusting the volume of a chamber. The projectile positioning method and apparatus perform the operative steps of (a) moving a projectile at a forward end of the chamber where its position defines the volume of the chamber; (b) measuring the temperature of a propellant charge to be placed in the chamber for firing the projectile and having temperature dependent performance characteristics; and (c) controlling the moving the projectile in response to the measured temperature of the propellant charge to cause the projectile to be placed at the exact position where it adjusts the amount of chamber volume to provide the correct degree of compensation for the measured temperature.

More particularly, moving of the projectile is accomplished using a reciprocatory ram having a variable working stroke. Hydraulic means are used for controlling operation of the ram. A temperature sensor is adapted to be coupled to the propellant charge or storage area for reading the temperature of the propellant charge These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
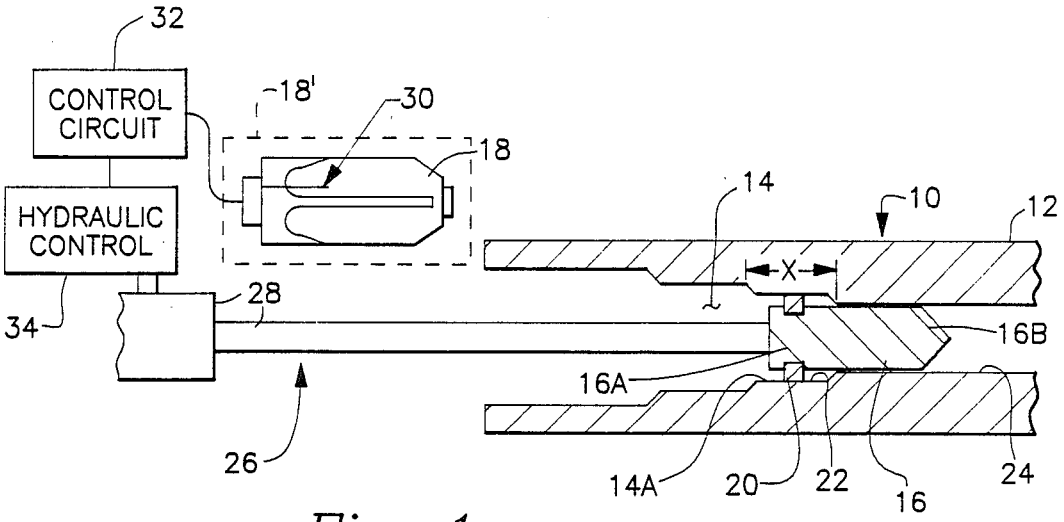
FIG. 1 is a longitudinal axial sectional view of a munition chamber and a schematic representation of the variable stroke projectile positioning system of the present invention.

Referring now to the drawings, and particularly to FIG. 1, there is shown in schematic form a gun 10 having a barrel 12 defining at its rear portion a chamber 14 adapted to receive a two-piece separately-loaded munition composed of a projectile 16 and a propellant charge 18. The projectile 16 and propellant charge 18 are separately loaded into the chamber 14 of the gun barrel 12 by an auto loader (not shown). Adjacent its trailing end, the projectile 16 is fitted circumferentially with an annular obturator 20 which seals between the exterior of the projectile 16 and an cylindrical recessed region 22 at the forward end of the chamber 14. A trailing portion 16A of the projectile 16 is coextensive with the chamber recessed region 22, whereas a leading portion 16B of the projectile 16 extends into a bore 24 of the gun barrel 12. The obturator 20 permits the projectile 16 to be placed and retained at any desired axial position between the limits identified by the "x" along the forward recessed region 22 of the chamber 14.

Figure 2:
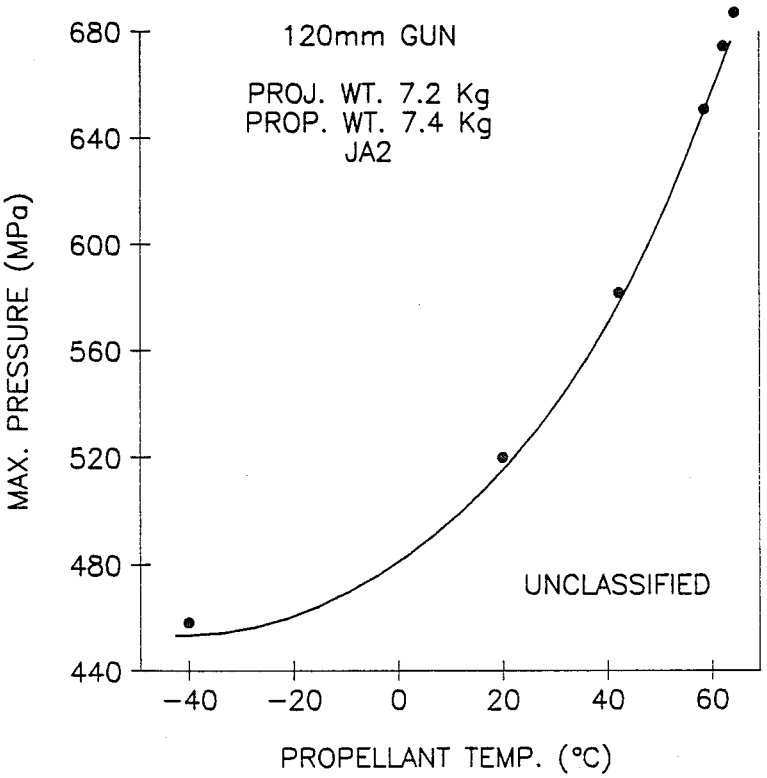
FIG. 2 is a graph depicting the relationship between variation in propellant chamber pressure as a function of propellant temperature for 120 mm kinetic energy ammunition.

The propellant typically used is temperature dependent, that is, the burning rate of the propellant is a function of the ambient temperature thereof. FIG. 2 shows the variation in the pressure produced as a function of temperature that is typical for 120 mm kinetic energy ammunition. Ordinarily, the highest chamber pressure is achieved at the maximum operational temperature limit of the ammunition. Therefore, at typical ambient temperatures around 20 degrees C., the pressure is substantially lower. For example, for the M829 cartridge, there is a net five percent loss in muzzle velocity at this temperature versus the velocity at the maximum temperature limit of 63 degrees C.

In the approach of the first patent application cross-referenced above, it is recognized that since the primary propellant charge for a given volume of the chamber provides greater average pressures behind the projectile as the ambient temperature of the ammunition increases, if the volume of the chamber is increased then the pressure is reduced, compensating for the higher temperature. The cross-referenced application proposes changing the volume of the chamber by adjusting the position of the projectile in the barrel. Adjusting the position of the projectile is accomplished in the cross-referenced application by ignition of a secondary propellant charge in the control tube which is itself temperature sensitive. The secondary propellant charge forces a piston down the control tube pushing the projectile in front of it to a new position which changes the volume of the chamber containing the primary propellant charge. Since the temperature of the secondary propellant charge is the same as the ambient temperature of the ammunition, it compensates for an increase in ambient temperature by creating a greater pressure and thereby applying an increased force to the piston to push the projectile farther forwardly in the barrel and further increase chamber volume.

The present invention provides for temperature compensating adjustment of the volume of the primary propellant chamber 14 in a dirferent way than that of the first application cross-referenced above. As shown in FIG. 1, the present invention relates to employment of a separate variable stroke projectile positioning system, generally designated 26, for adjusting the position of the projectile 16 and thereby the volume of the chamber 14.

In its basic components, the apparatus of the projectile positioning system 26 for adjusting the volume of the gun chamber 14 includes means, preferably in the form of a reciprocatory ram 28 having a variable working stroke, for moving the projectile 16 at a forward end 14A of the chamber 14 where its position defines the volume of the chamber. The apparatus of the projectile positioning system also includes means, preferably in the form of a temperature sensor 30, for measuring the temperature of a propellant charge 18 to be placed in the chamber 14 for firing the projectile 16. As stated above, the propellant charge 18 used has temperature dependent performance characteristics.

Lastly, the apparatus of the projectile positioning system 26 includes control means, preferably in the form of a control circuit 32 and hydraulic control 34 which can be of any suitable construction within the purview of one of ordinary skill in the art. The control means 32, 34 are responsive to the temperature of the propellant charge 18 measured by the temperature sensor 30 for controlling hydraulically the operation of the reciprocatory ram 28 in moving the projectile 16 to place it at the exact position where it adjusts the amount of chamber volume to provide the correct degree of compensation for the measured temperature.

Figure 3A:
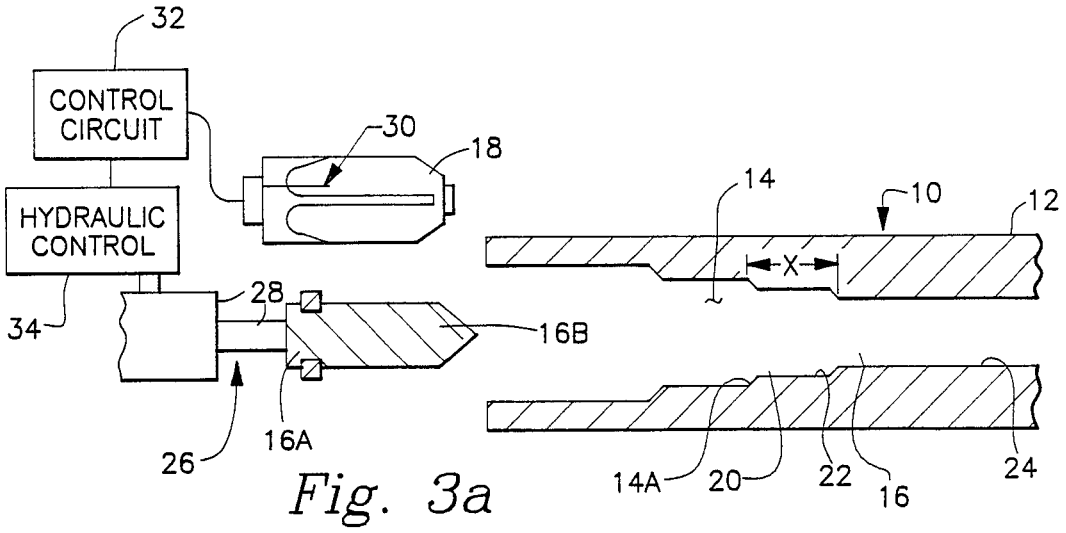
FIGS. 3A–3C are schematic representations of the projectile positioning system of FIG. 1 at successive stages in temperature compensating adjustment of the position of a projectile and thereby the volume of the propellant chamber.
Figure 3B:
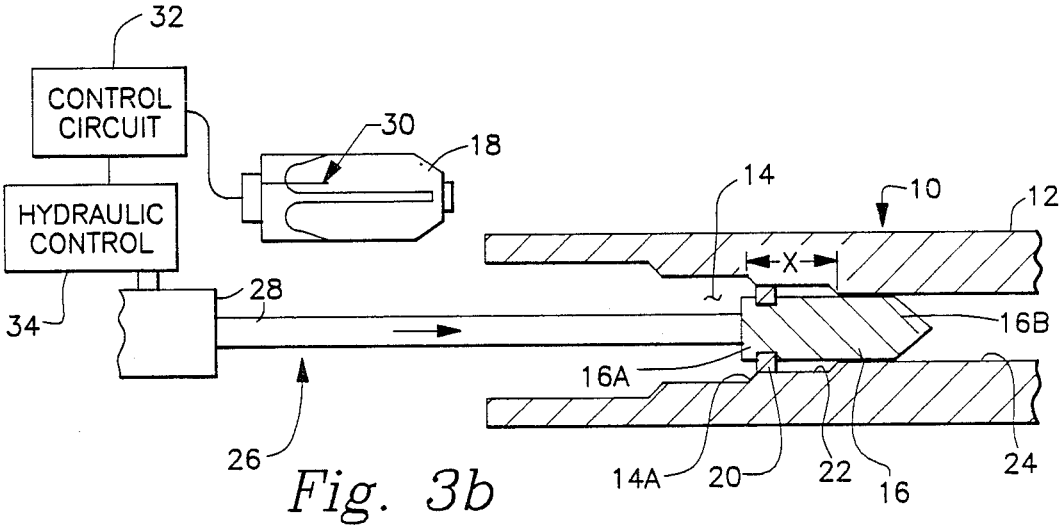
Figure 3C:
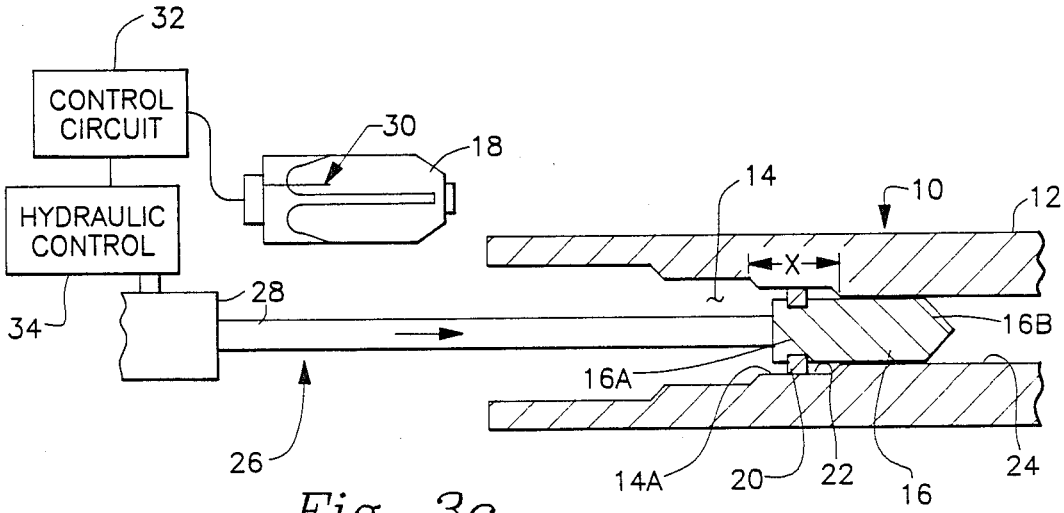

In FIG. 3A, the ram 28 is shown retracted for allowing insertion of the projectile 16 into the gun barrel 12. The ram is assumed to be part of the auto loader system, i.e., it loads the projectile into the chamber and continues pushing until the projectile stops at the right location to compensate for the temperature of the propellant 18. In FIG. 3B, the ram 28 is shown extended into engagement with the rear end of the projectile 16 but before moving it to the position desired. In FIG. 3C, the ram 28 is shown after being further extended to move and place the projectile 16 at the exact position where it adjusts the amount of chamber volume to provide the correct degree of compensation for the measured temperature.

The temperature sensor 30 is adapted to be coupled directly to the propellant charge, as illustrated schematically in FIGS. 1 and 3A–3C, for reading the temperature of the propellant charge. Alternatively, the temperature sensor 30 can be used to read the temperature of the propellant charge storage area 18'. It is possible that the propellant temperature can be inferred from the temperature of the propellant storage area in which case no modification needs to be made to the propellant charge 18 to couple the sensor 30 to it.

To recap, the reciprocatory ram 28 must push the projectile 16 the correct distance forward to leave the correct amount of chamber volume behind it, for the given propellant temperature. The obturator 20 holds the projectile 16 at the position to which it was pushed once the ram 28 has been withdrawn.

After the ram 28 is withdrawn, the propellant charge 18 is then inserted by the ram and ignited. Given that the projectile 16 is in the proper position, the pressure output will exactly reach the maximum operational pressure and deliver the best possible velocity for that temperature.

The positioning system 26 can also allow for the sensing of what projectile type is being loaded and to adjust for the distance between the obturator 20 and the rear face of the projectile for each projectile type.

Thus, it is seen that the apparatus and method of the projectile positioning system 26 of the present invention varies the position of the projectile 16 as a function of the ambient temperature of the propellant charge 18. In this way, initial chamber volume is adjusted so as to precisely compensate for the change in burning rate as a function of initial propellant temperature. This allows the ammunition to operate at maximum allowable pressure and velocity across the required temperature range. The system 26 essentially eliminates the variation in temperature compensation performance caused by natural variations in ignition time and bore friction, which variations affect some temperature compensating control tube concepts.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

The embodiments of the invention in which an exclusive property or right is claimed are defined as follows:

1. A temperature compensating variable stroke projectile positioning apparatus for adjusting the volume of a chamber, said projectile positioning apparatus comprising:

(a) means for moving the projectile at a forward end of the chamber where its position defines the volume of the chamber;

(b) means for measuring the temperature of a propellant charge to be placed in the chamber for firing the projectile and having temperature dependent performance characteristics; and (c) means responsive to the measured temperature of the propellant charge for controlling said moving means in moving the projectile to cause said moving means to place the projectile at an exact position where it adjusts the amount of chamber volume to provide the correct degree of compensation for the measured temperature.

2. The positioning apparatus of claim 1 wherein said moving means includes a reciprocatory ram having a variable working stroke.

3. The positioning apparatus of claim 2 wherein said controlling means includes hydraulic means for controlling operation of said ram.

4. The positioning apparatus of claim 1 wherein said measuring means is a temperature sensor adapted to be coupled to and read the temperature of the propellant charge.

5. The positioning apparatus of claim 1 wherein said measuring means is a temperature sensor adapted to read the temperature of a propellant charge storage area.

6. A temperature compensating variable stroke projectile positioning method for adjusting the volume of a chamber, said projectile positioning method comprising the steps of:

(a) moving a projectile at a forward end of the chamber where its position defines the volume of the chamber;

(b) measuring the temperature of a propellant charge to be placed in the chamber for firing the projectile and having temperature dependent performance characteristics; and (c) controlling the moving of the projectile in response to the measured temperature of the propellant charge to cause the projectile to be placed at an exact position where it adjusts the amount of chamber volume to provide the correct degree of compensation for the measured temperature.

7. The positioning method of claim 6 wherein said moving of the projectile is performed by extending a ram having a variable working stroke.

8. The positioning method of claim 7 wherein the extending of the ram is controlled hydraulically.

9. The positioning method of claim 6 wherein said temperature measuring is performed by taking a temperature reading on the propellant charge itself before it is placed in the chamber.

10. The positioning apparatus of claim 6 wherein said temperature measuring is performed by taking a temperature reading at a propellant charge storage area.

* * * * *